United States Patent [19]

Johnston

[11] Patent Number: 4,468,024

[45] Date of Patent: Aug. 28, 1984

[54] VAULTING POLE END PLUG

[76] Inventor: David F. Johnston, P.O. Box 15377, Riyadh, Saudi Arabia

[21] Appl. No.: 402,926

[22] Filed: Jul. 29, 1982

[51] Int. Cl.[3] ..... A63B 5/06

[52] U.S. Cl. ..... 272/104

[58] Field of Search ..... 272/100, 101, 104, 114, 272/93, 70.1, 70.2, 70.3, 70.4; 135/77–84; 248/188.9, 359.1, 356, 353, 677

[56] References Cited

U.S. PATENT DOCUMENTS

| | | | |
|---|---|---|---|
| 1,917,601 | 7/1933 | Schermerhorn | 248/188.9 |
| 3,491,999 | 1/1970 | Lindler | 272/104 |

FOREIGN PATENT DOCUMENTS

| | | | |
|---|---|---|---|
| 249610 | 11/1962 | Australia | 248/188.9 |
| 1028474 | 5/1966 | United Kingdom | 248/188.9 |
| 1273565 | 5/1972 | United Kingdom | 248/188.9 |

*Primary Examiner*—Richard J. Apley
*Assistant Examiner*—S. R. Crow
*Attorney, Agent, or Firm*—Cushman, Darby & Cushman

[57] ABSTRACT

A pivot end plug or end cap for vaulting poles designed to provide an eccentric portion at the pivoting bottom end of the pole as it pivots within the plant box. The eccentric portion of the end plug causes the bottom of the vaulting pole to move rearwardly away from the front wall of the plant box thereby permitting a greater forward penetration of the pole and the vaulter into the pit area.

6 Claims, 5 Drawing Figures

VAULTING POLE END PLUG

FIELD OF THE INVENTION

This invention relates to the sport of pole vaulting and, in particular, to an improvement in the plug for enclosing and protecting the bottom end of vaulting poles about which pivoting occurs.

BACKGROUND OF THE PRESENT INVENTION

The sport of pole vaulting is relatively old and in vaulting, the vaulter is required to clear a crossbar which is releasably held between two standards or uprights spaced 12 to 14 feet apart on either side of a cusioned pit area.

In vaulting, the vaulter grips the pole near one or the top end with his hands spaced apart and with the other or tip end of the pole positioned away from him approximately at eye level and at an angle slightly across the body. The vaulter then begins his in run down a relatively long runway and as the end of the runway is approached, the tip or bottom end of the pole is lowered toward the plant box, a depression at the end of the runway defined by two side walls and a sloping bottom wall. The plant box is approximately centered between the standards supporting the crossbar and terminates at a front wall which is angled with respect to the sloping bottom wall at a fixed 105 degree angle.

The pole will have been fully planted in the plant box when the tip or pivot end lies adjacent the edge defined between the sloping bottom and front wall surfaces and in contact with those surfaces which cooperate to define the pivot point for the bottom of the pole. Usually, the planting of the pole is started 3 to 4 strides before the taking or jumping off point. During this time the hands have remained spread approximately 18 inches or 40 centimeters apart and will continue to remain in that condition at least throughout the initial phases of the vault. Nearing the end of the in run, the pole will be driven into the plant box and will bend into a curvilinear fashion causing the bottom end to pivot and causing the upper end to raise to the shoulder level at which point it is pressed up quickly. Pressing up of the pole should be timed so that the take-off foot is planted on the runway as the top arm on the pole is snapped to a straight up position thus helping the vaulter drive or jump off the ground effectively at the right point. Thereafter, the lead knee drives forward and up but may drop slightly after takeoff to allow the vaulter's body to hang beneath the bending pole. It is preferable that the upper arm be kept straight while the lower arm pushes the pole toward the pit in order to keep the pole out in front of the vaulter's body and to assure that it continues its forward progression toward the pit and beneath the cross bar.

The pole continues bending and moving or rotating forward toward the pit until the bottom portion abuts or comes into contact with the upper corner of the plant box adjacent the front wall and the ground surface at which point the pole will begin to finish its bending and start its catapulting action. At this time the vaulter will enter a tuck position and shoot upwardly so as to be in a position to turn and extend his hips as high as possible. At this point, the vaulter will pull or push himself into a one handed handstand facing the bar with the momentum gained from the thrust of the pole and his pulling or pushing into the hand stand allowing the vaulter to reach the apogee of his arc, hopefully clearing the bar and dropping into the pit without removing the crossbar.

The sport of pole vaulting, however, is fast becoming a highly sophisticated and technical event requiring the integration of a number of factors, some of which include technique and gymnastic ability. Another important factor, however, is the technology that can be engineered into the equipment being used. While ability is something that can, to some extent, be gained by each vaulter, the technique used or developed is perhaps directly relatable to the quality of equipment and then can often be a cause and effect relationship.

In order to achieve the desire of going ever higher, it has been thought for some time that it is important, from a technique standpoint, to allow the body to hang beneath the continuing bending pole for as long a period as possible in order to make the most use of the vaulter's momentum. However, vaulting poles, at the present, have a limit as to how high one can hold on the pole adjacent the top end. Further, the fixed angle of 105 degrees between the bottom and front sloping surfaces of the plant box defines with the ground and the front wall a top corner of the plant box that will be hit by the pole thereby preventing the pole from attaining more than a predetermined amount of bend. These two factors together restrict the possible amount of bending and forward penetration that can be achieved even if a vaulter's technique is good. This directly effects how high a vaulter can jump and can influence the outcome of competition.

SUMMARY OF THE PRESENT INVENTION

The present invention's primary object is to provide additional forward penetration for the pole into the pit and if that can be accomplished, the vaulter can hold higher on the pole and hang for a greater period of time below the still moving and rotating pole. By being allowed to do this, the vaulter can continue to make use of his forward velocity and momentum developed coming down the runway, the forward velocity of the pole itself can continue to develop and allow more force to be developed in the pole and in the jumper's arc. When these elements can be combined together, the fact that better penetration into the pit area has been achieved, will provide that vaulter at least with the opportunity to use this increasingly generated force and to resolve those forces more appropriately toward the crossbar thereby hopefully resulting in a higher arc.

I have found that a greater amount of penetration of the pole and thus the increase in forward velocity and the appropriate use of the forces created thereby can be achieved if the end of the pole pivoting within the plant box can be caused to move away from the forward wall of that plant box as it pivots. By allowing movement of the bottom or tip end, a corresponding movement in the upper end will occur. This movement at the upper end will permit more forward penetration and allow additional amounts of bending forces to develop along the entire length of the pole with all of this tending to resolve into greater penetration of the pole and of the vaulter toward the pit area.

It is well known that jumping poles have top (strong) and bottom (weak) sides. I have found that by changing the shape of the traditional plug at the base of the pole to include an eccentric portion designed with the top side of the pole, that such a shape will effectively control movement of the bottom of the pole. During pivoting of the plug within the plant box, the eccentric portion of the plug moves the bottom of the pole away from the front wall of the plant box. I have found that by moving the bottom of the pole away from that front wall by as little as one half an inch, a complimentary movement of approximately 10 inches will be produced at the upper end of the 16–18 foot vault pole. This permits additional rotation to occur because the pole has been moved away from the upper corner of the plant box. Accordingly, this additional movement at the top of the pole produces additional penetration of the pole into the pit area which in turn allows the vaulter to hold higher on the pole and hang for a longer period of time as the pole rotates. The combined effect is that additional force is developed in the pole and the vaulter is placed in a better position to use his ability to make the most use of the momentum and forces developed in approaching the jump. And, thus, to attain a higher arc producing higher vaults.

Other objects, features, and characteristics of the present invention, as well as the methods and operation and functions of the related elements of the structure, and to the combination of parts and economies of manufacture, will become more apparent upon consideration of the following detailed description and the appended claims with reference to the accompanying drawings, all of which form a part of this specification, wherein like reference numerals designate corresponding parts in the various figures.

DETAILED DESCRIPTION OF THE PREFERRED EMBODIMENT OF THE PRESENT INVENTION

Figure 1:
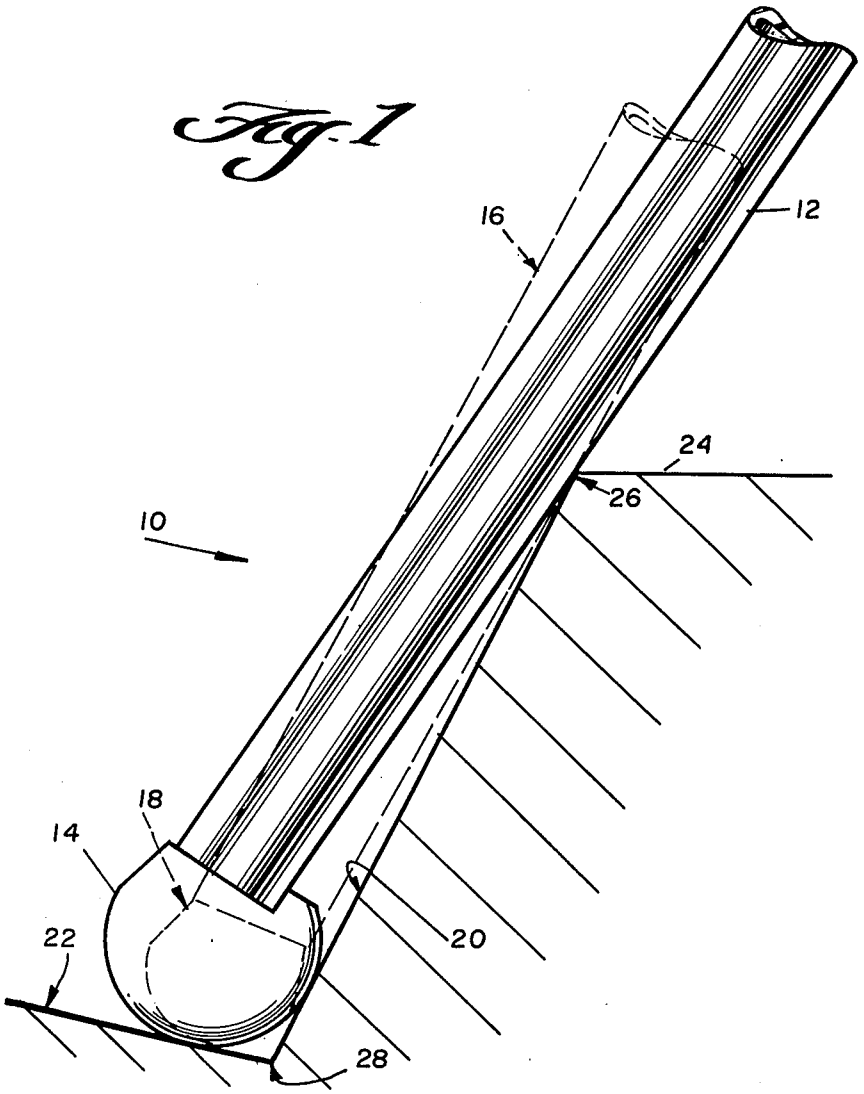
FIG. 1 is side, elevational view of a portion of a vaulting pole and a portion of the plant box showing the present invention in full line and a prior art poles and end plugs in phantom.

Turning now to FIG. 1, the present invention is comprised of a vaulting pole assembly shown in solid lines, generally indicated at 10, and comprised of a pole 12 and a bottom end plug 14. The dotted line representation in FIG. 1 is of a prior art pole with that pole assembly including a pole 16 and a conventional bottom end or pivot plug 18.

Each of the poles indicated at 12 and 16 in FIG. 1, can be identical and formed from reinforced fiberglass having lengths that vary from 10 feet to approximately 18 feet with outer diameters ranging from about three quarters of an inch to two inches. The thickness of the sidewall can vary but will normally be about an ⅛ of an inch. An exemplary pole as described in U.S. Pat. No. 3,969,557.

With respect to the conventional plug, indicated in dotted line at 18, it will be noted that the form of the plug is essentially symmetrical and is not a great deal larger than the outer diameter of the vaulting pole. It is designed to primarily provide a good pivot point for the pole and is preferably constructed from material that will not slip out of the vault box. Likewise, because of its shape, the rotation of the pole about that end plug will be substantially uniform in character and as shown in dotted lines, plug 18 will allow the bottom portion of the pole itself to lie quite close to the front wall 20 of the vault box. The slanted bottom wall of the plant box is indicated at 22 while the top level of the plant box is shown at 24 thus defining an upper corner 26 between walls 20 and 24 and walls 20 and 22 defining a bottom corner 28. The plant box is generally indicated at 30 in FIG. 5 with the runway generally being indicated at 32.

Figure 2:
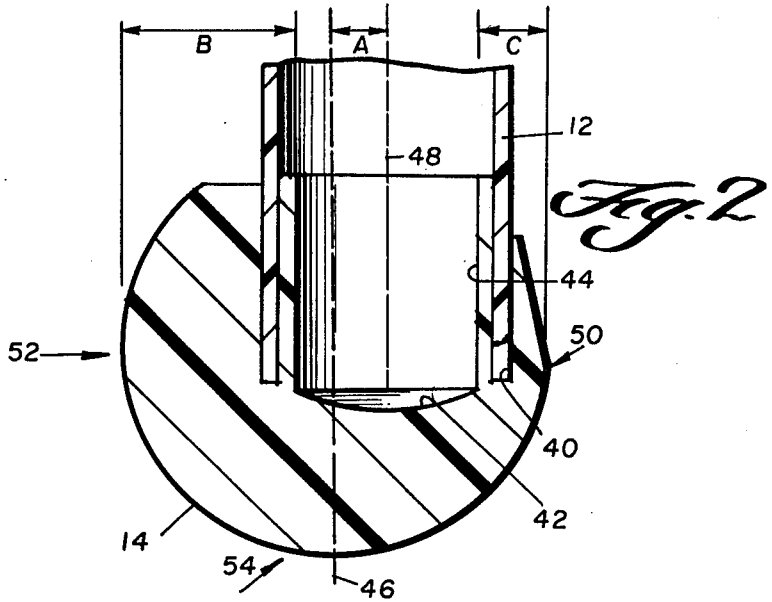
FIG. 2 is a diagrammatic cross-sectional view of the bottom end pivot plug according to the present invention.
Figure 3:
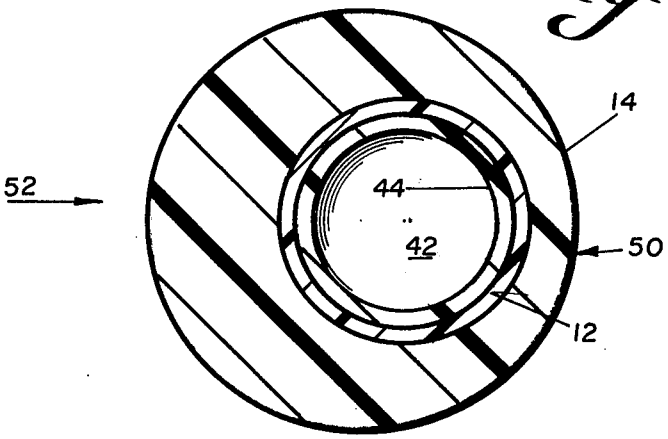
FIG. 3 is a top, plan cross-section of the end pivot plug according to the present invention as shown in FIG. 2.

Turning now to FIGS. 2 and 3, two cross-sectional views of end plug 14 according to the present invention are set forth with FIG. 2 being a cross-sectional, side elevation whereas FIG. 3 shows a cross-sectional top plan view. As best shown in FIG. 2, end plug 14 is formed with an outer annular cavity 40 and an inner annular cavity or core area 42. Defined therebetween is an upstanding cylindrical sleeve 44. Pole 12, which is hollow, and in particular the bottom end portion of pole 12, is retained within end plug 14 by being force fit within annular cavity 40 with the external and internal dimensions of cavity 40 being substantially equal to the side walls dimensions and diameter of the lower end of pole 12. Likewise, the exterior surface of cylindrical sleeve 44 will extend upwardly into the hollow interior portion of pole 12 and the outer diameter of cylindrical sleeve 44 will be substantially equal to the internal diameter of pole 12. With the dimensions of cavity 40 and sleeve 44 being approximately equal to the dimensions of pole 12, the pole can be force fit into cavity 40 where it will be held in place without the use of adhesives. It should be kept in mind that vaulting pole end plugs are usually replaced on a fairly frequent basis as they get worn and the end of the poles can actually be forced through the plug material due to the pressures being generated during jumping.

End plugs made according to the present invention can be constructed from materials similar to those used to construct conventional end plugs such as nylon or nylon and polyethylene composition. However, other compositions such as rubber could be used. It is sufficient that the end plug be comprised of a sufficiently resilient and non-slip material so that during rotation within the plant box, the bottom end of the pole will not slip out.

The central axis of plug 14 is indicated at 46 whereas the central axis of core area 42 and cavity 40 is indicated at 48. In that regard, it should be noted that plugs 14 according to the present invention are designed to have a rear portion 50, a front portion 52 and a bottom portion 54. As will be seen in FIG. 2, axis 48 corresponding to the axis for annular cavity 40 and core 42 is offset rearwardly from axis 46 of the plug itself a distance A with distance A varying from about three-eighths to about one half of an inch. The overall outer diameter of the sphere from which the major portion of plug 14 is constructed is approximately 2¾". Thus, by moving the axis of core 42 rearwardly distance A, the distance from the interior wall of core 42 closest to the front portion 52 to the front surface of the plug, indicated at B, would be increased a like amount to approximately 1¼" to or about 1⅜". Conversely, the thickness of the rear portion of the plug will be reduced by that same value with the distance from the interior of sleeve 44 closest to the rear of the plug to the rear of the plug, indicated at C in FIG. 2, will become approximately ½" to about ⅜". Where distance A was approximately ⅜" B was approximately 1¼" and C approximately 1½". The outer diameter of pole 12 will be about 1⅝", the inner diameter of the pole will be approximately 1⅜" making the wall thickness of the pole approximately ⅛". Likewise, the thickness of sleeve 44 is also approximately ⅛". Further, the distance from the bottom of core 42 to the bottom 54 of plug 14 is approximately 1".

Since vaulting poles conventionally have top and bottom sides or surfaces and are always carried with the top oriented in that position, it is essential that end plug 14 be situated on the end of pole 12 in a particular manner where the front portion 52 is aligned with the top surface of the pole and the rear portion 50 is aligned with the bottom surface of the pole.

Turning now to FIG. 3, it will be seen that while the distances between the front and rear of the pole where it mounts within plug 14 have been changed with respect to rear surface 50 and front surface 52. This rearward movement or positioning of the pole within the plug is moved rearwardly along the center of the plug, when viewed from above, so that the distances on either side of the pole to the periphery of the plug remains substantially uniform.

THE OPERATION AND RESULTS OF USING THE PRESENT INVENTION

Figure 4:
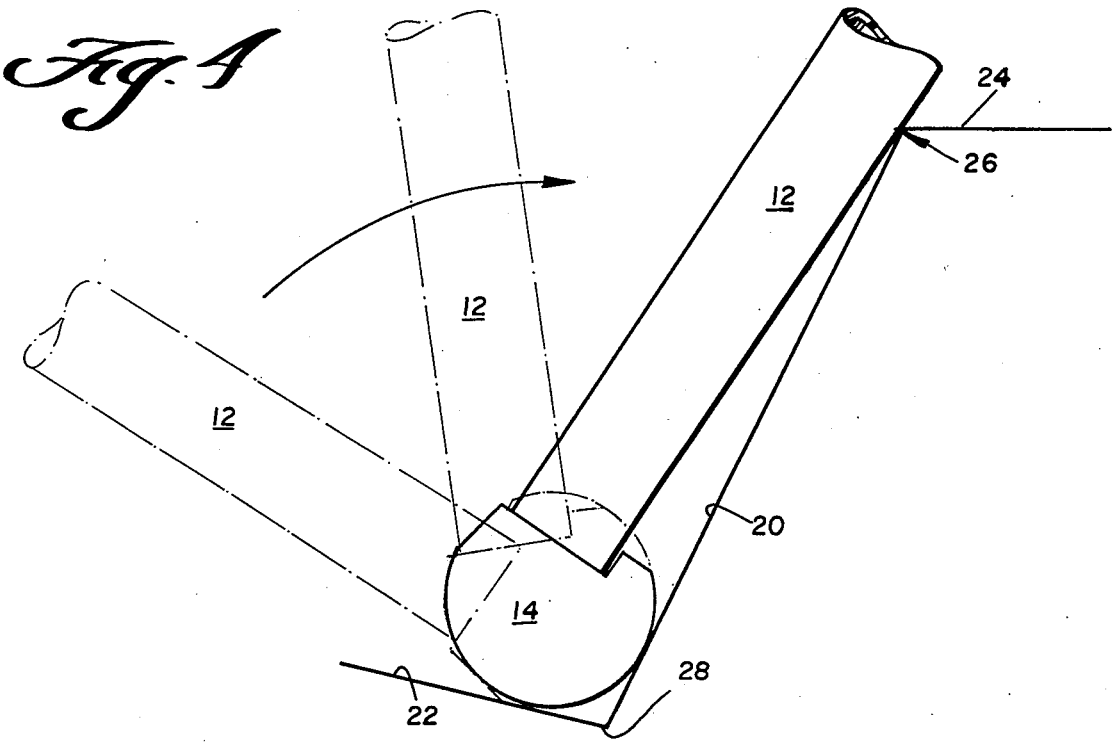
FIG. 4 is a diagrammatic, side elevation of the positions through which the vaulting pole and end pivot plug will move through as the vaulting pole pivots from its plant position through it curvilinear flexing and its return to its initial linear condition.
Figure 5:
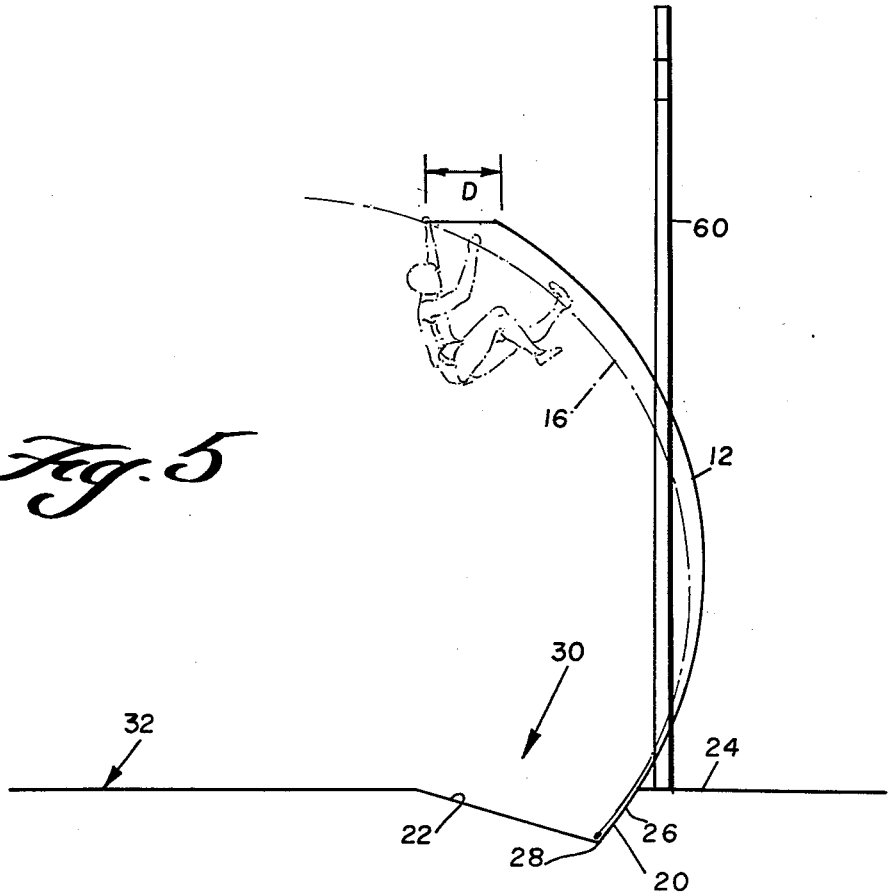
FIG. 5 is a diagrammatic, side elevational view showing a comparison between the present invention and a prior art vaulting pole relative to the amount of forward penetration gained with the present invention.

Having described the details of my new end plug, reference to FIGS. 4 and 5 will show how the plug operates within the plant box 30 and the effects and results achieved by its use.

With reference first to FIG. 4, the dotted line position of pole 12 that is closest to the sloping bottom wall 22 of the plant box is designed to approximately indicate the position of the bottom portion of pole 12 and plug 14 shortly after the pole has been planted. The next or central dotted line representation of pole 12 and plug 14 shows the pole approximately half way through its curvilinear bending during the jumping sequence. The full line representation of pole 12 and plug 14 shows the pole at its point of greatest forward penetration, a position which may or may not be reached in a jump. However, when pole 12 does contact upper corner 26, that begins to establish the point at which further forward penetration of the pole into the pit area, or rotation of the pole in a forward direction toward the pit, will be substantially reduced if not terminated.

With reference to the first position of pole 12 in FIG. 4, that position substantially at the point of planting, plug 14 will be in contact with surfaces 22 and 20 adjacent corner 26. It should be pointed out, the angle at corner 26 between walls 22 and 20 is specifically and consistently set at 105 degrees pursuant to international jumping regulations. As pole 12 pivots or moves into the second position, it will be clearly seen that pivoting of plug 14 will begin to push the bottom of the pole away from wall 20 unlike plug 18 shown in FIG. 1. The forward portion 52 of the plug begins to come into contact with wall 20 of the plant box and as rotation continues, the front portion of the plug will operate as an eccentric forcing the bottom of pole 12 farther away from wall 20 than would otherwise be the case.

In this regard, the full line and dotted line positions of the two poles in FIG. 1 clearly shows that the bottom of pole 12 is spaced farther from wall 20 than the bottom of pole 16. This will allow pole 12 to develop a greater angle allowing more forward penetration prior to contacting the upper corner 26 than was the case with plug 18 and pole 16.

With reference to FIG. 5, the dotted line representation represents pole 16 from FIG. 1 supplied with a conventional end plug. The solid line representation shows pole 12 having the end plug according to the present invention. With continuing reference to FIGS. 1 and 5, the fact that pole 16 lies much closer to wall 20 along its entire length from corner 26 to corner 28 prevents further forward penetration of pole 16 at a point well before that which occurs with pole 12 provided with the plug according to the present invention. By forward pentration is meant the distance that the jumper and pole 16 can move or rotate into the pit area past standards 60 which support the crossbar (not shown).

With respect to pole 12, however, plug 14 moves the bottom end of pole 12 away from wall 20 thereby forming a greater angle between the bottom of the poles and the upper corner 26, along the top or exterior surface of the pole facing wall 20. This greater angle allows the greater forward penetration of pole 12, as shown in the solid line representation of FIG. 5, to be achieved. The additional amount of forward penetration is shown by distance D. I have found that by moving the bottom end of pole 12 approximately ½" away from wall 20 adjacent the bottom of that pole the distance D corresponding to the added forward penetration of pole 12 can be approximately 10 to about 13 inches. By moving the bottom of the pole away from surface 20 in the plant box, the greater angle of the pole relative to wall 20 keeps the pole away from upper corner 26 for a longer period of time, thus allowing or permitting a greater range of movement for the vaulting pole from the plant position to the attainment of its full vertical position. By allowing this greater range of movement, a jumper can make more efficient and effective use of his forward momentum and thus develop greater forces at the point of takeoff and throughout the jump. This allows the jumper to hold higher on the pole and to develop a greater vertical position at an earlier point in the jumping cycle. By combining these various aspects together, the plug according to the present invention allows a jumper to actually improve the height of his arc with respect to the crossbar thereby permitting the attainment of higher jumps.

While the invention has been described in connection with what is presently considered to be the most practical and preferred embodiment, it is to be understood that the invention is not to be limited to the disclosed embodiment but, on the contrary, is intended to cover various modifications and equivalent arrangements included within the spirit and scope of the appended claims, which scope is to be accorded the broadest interpretation so as to encompass all such modifications and equivalent structures.

What I claim is:

1. A pivot plug for pole vaulting use at the bottom end of a vaulting pole for improving pole vaulting performance, said pole vaulting pivot plug comprising a body having a substantially spherically shaped lower portion extending around a central vertical axis of said body and means defining a cavity in said pivot plug for receiving the bottom end of a vaulting pole, said cavity means being offset from said vertical axis of said body so that the inserted bottom of said pole vaulting pole is positioned closer to one side of said spherically shaped lower portion than the other so that an eccentric portion is defined in said body in that side farthest from the cavity and the pole.

2. A pole vaulting pivot plug as in claim 1 comprised of nylon.

3. A pole vaulting pivot plug as in claim 1 comprised of a mixture of nylon and polyethylene.

4. A vaulting pole assembly comprising a resin impregnated reinforced hollow tube having top and bottom ends, means defining a handle portion adjacent the top end and a pivot plug having an eccentric portion, said pivot plug having an axially offset recess for receiving said pole so that said plug can be attached to said bottom end so that the eccentric portion extends outward of said tube.

5. A plug for forming the bottom end of a pole vaulting pole comprising a substantially spherical member having a central vertical axis and means including means defining a recess for receiving the bottom end of the pole, said recess means being positioned offset from the central vertical axis a predetermined amount so that said plug is formed into an eccentric member so as to extend away from one side of the bottom of the pole a greater distance than from the opposite side.

6. A pivot end plug for a pole vaulting pole comprising an exterior body formed substantially as a sphere and having a central vertical axis including means defining first and second axially aligned cylindrical recesses, the first recess being inwardly offset from and having a smaller internal diameter than the second so as to define a cylindrical wall member therebetween, the axis of said cylindrical recesses being parallel to but offset from said vertical axis of said sphere so that said cylindrical recesses are closer to one side of said sphere than the opposite side thereby defining, relative to said recesses, an eccentric portion of said sphere.

* * * * *